United States Patent [19]

Ishida

[11] Patent Number: 4,964,638

[45] Date of Patent: Oct. 23, 1990

[54] CONTROL APPARATUS FOR GAME MACHINES

[75] Inventor: Naomi Ishida, Tokyo, Japan

[73] Assignee: Kabushiki Kaisha Universal, Tochigi, Japan

[21] Appl. No.: 352,541

[22] Filed: May 16, 1989

[30] Foreign Application Priority Data

May 16, 1988 [JP] Japan ..... 63-118586

[51] Int. Cl.[5] ..... A63B 71/00

[52] U.S. Cl. ..... 273/138 A; 273/143 R; 364/412

[58] Field of Search ..... 273/138 A, 143 R, ; 364/412, 410, 717

[56] References Cited

U.S. PATENT DOCUMENTS

| | | | |
|---|---|---|---|
| 4,072,930 | 2/1978 | Lucero et al. | 273/138 A |
| 4,679,143 | 7/1987 | Kagiwara | 273/138 A |
| 4,747,600 | 5/1988 | Richardson | 273/138 A |
| 4,775,937 | 10/1988 | Bell | 273/138 A |
| 4,838,552 | 6/1989 | Hagiwara | 273/138 A |
| 4,842,278 | 6/1989 | Markowicz | 273/138 A |
| 4,844,464 | 7/1989 | Berge | 273/138 A |

FOREIGN PATENT DOCUMENTS

| | | | |
|---|---|---|---|
| 2201279 | 8/1988 | United Kingdom | 273/143 R |

*Primary Examiner*—Edward M. Coven
*Assistant Examiner*—Dean Small
*Attorney, Agent, or Firm*—Young & Thompson

[57] ABSTRACT

In a control system wherein a master control unit controls a plurality of game machines, the master control unit is provided with two calculators and a microprocessor. The two calculators accumultate, at different rates, values each corresponding to the number of coins inserted into each of thé game machines for every game. The two different accumulated values are used alternately to set the amount of money to be paid out for a particular hit and one of the values is indicated by an indicator. For every occurrence of a hit, the microprocessor orders that coins be paid out according to the indicated value and that the indicated value is alternately changed from one of the two accumulated values to the other.

13 Claims, 8 Drawing Sheets

| | 0 | 1 | 2 | 3 | 4 | 5 |
|---|---|---|---|---|---|---|
| 0 | | | DATA REQUEST | COIN DATA | | |
| 1 | | | JP DATA | JP OCCURENCE | | |
| 2 | STX | | JP DATA CONFIRMATION | JP DATA | | |
| 3 | ETX | | JP RESPONCE | JP RESPONCE | | |
| 4 | | | | JP RESET | | |
| 5 | | | | RESET RESPONCE | | |

CONTROL APPARATUS FOR GAME MACHINES

BACKGROUND OF THE INVENTION

The present invention relates to a control apparatus for game machines, and more particularly to a control apparatus for coin-operated game machines such as slot machines into which coins or tokens (which are hereinafter referred to as "coins" for simplicity) are inserted for playing a game.

In casinos or game centers, having a large number of coin-operated game machines, it is known to provide a control system in which the game machines are divided into groups in each of which a special favor is enjoyed when a specific win is accomplished. For example, slot machines are divided into groups each of which has about 20 to 30 slot machines and particular hits such as jackpots (a jackpot is the largest hit of a slot machine game and is hereinafter referred to as a "JP") are processed for each group by a so-called progressive method.

In this progressive JP-process, a master control unit controls a plurality of slot machines, for example, 30 slot machines as one group and accumulates a predetermined percentage of an amount of money corresponding to the number of coins inserted into each slot machine of the group. When a JP occurs in one of the slot machines, the master control unit orders the slot machine to pay out coins corresponding in number of the accumulated money. As the accumulated money to be paid out is indicated by an indicator, the players' enjoyment is enhanced by the hope of hitting a JP which pays a large amount of money increasing as time passes.

In a conventional JP-process by the progressive method, the money accumulated by the master control unit is cleared to zero and the indicator correspondingly indicates zero after a JP occurs. Subsequent players lose interest in hitting such a small JP.

To solve this problem, in another progressive JP-process, a minimum amount of money is set up as a reserve and the accumulation starts from that minimum amount of money. A player hitting a JP can receive prize money in an amount greater than the minimum amount of money even when the JP occurs soon after the last occurrence of a JP. However, the minimum amount of money cannot be set too high, lest it distort pay-out ratio. Accordingly, the prize for a JP which occurs soon after the last JP is rather small.

OBJECT OF THE INVENTION

It is therefore an object of the present invention to provide a control apparatus for game machines, by which the expectation of making a large hit is sustained even just after an occurrence of the particular win.

SUMMARY OF THE INVENTION

For achieving this and other objects and advantages, according to the present invention, there is provided a control apparatus comprising first and second calculating means and a control means. The first calculating means calculates an accumulation value by accumulating, at a predetermined rate, the value of coins inserted in each of the game machines belonging to one group. The second calculating means calculates another accumulation value by accumulating, at another predetermined rate, the value of inserted coins. The control means orders an indicator to indicate one of the accumulated values as a pay-out value representing the amount of money or the number of coins to be paid out when a particular hit such as a JP occurs. When the particular hit occurs in one of the game machines, the control means orders the game machine to pay out the coins according to the indicated pay-out value and orders the indicator to indicate the other accumulated value as a new pay-out value. If the accumulated value is a fraction, the value obtained by rounding up or rounding down the fraction is indicated.

In a preferred embodiment of the present invention, the control apparatus further comprises a setting means for setting an initial value in the calculation means which has stored the accumulated value used as the pay-out value, after the occurrence of a win.

According to a feature of the present invention, as the pay-out value which is being accumulated and which increases is indicated, players can start or continue the game, and can anticipate winning a large amount of money, even just after a hit takes place.

According to another feature of the present invention, if a particular win occurs just after another win, a large number of coins appropriate to the particular hit can still be paid out because of the setting of an initial value.

BRIEF DESCRIPTION OF THE DRAWINGS

These and other objects and features of the invention will be seen by reference to the following description, taken in connection with the accompanying drawings, in which.

DETAILED DESCRIPTION OF THE INVENTION

Figure 1:
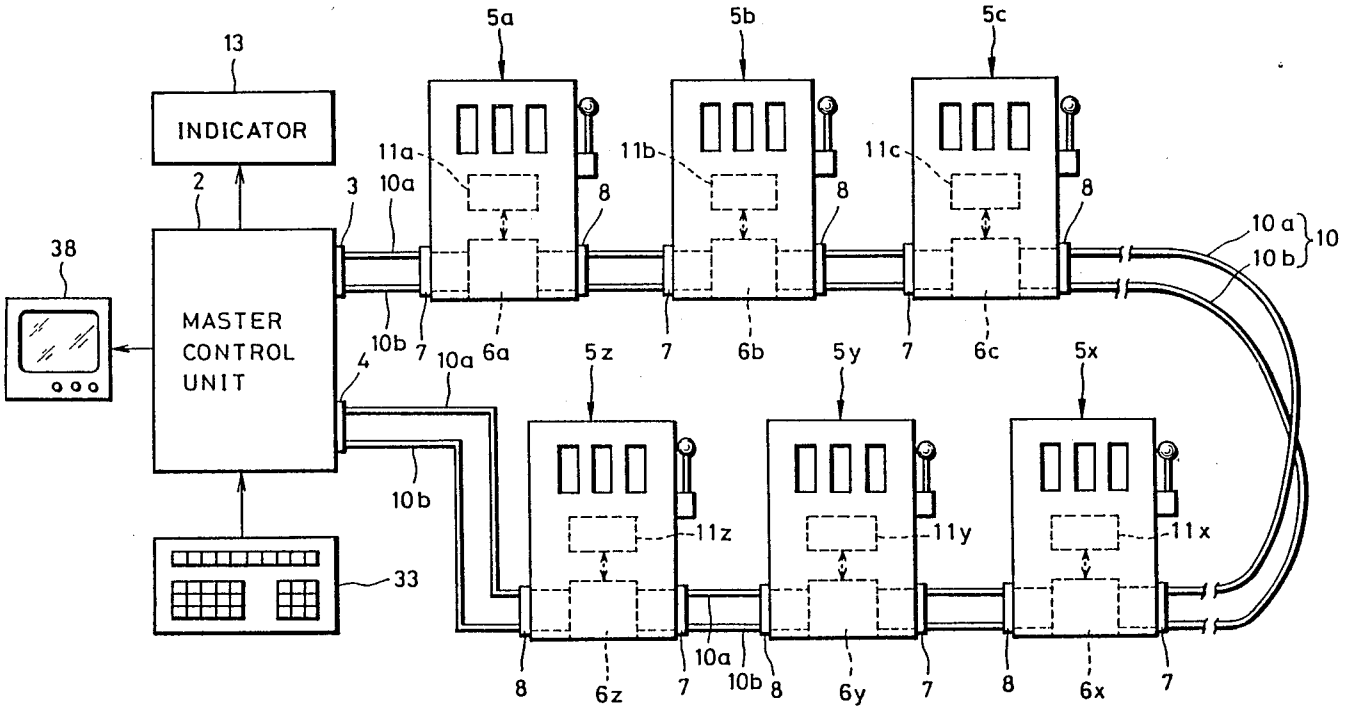
FIG. 1 is a schematic view showing a control system in which a master control unit embodying the present invention is used for controlling slot machines.

Referring now to the drawings, wherein like reference characters designate like or corresponding parts throughout the twelve views, FIG. 1 shows a control system which operates according to a progressive method for a particular hit such as JP. A master control unit 2 is provided with a pair of first and second connectors 3 and 4 having the same construction. Provided in a plurality of slot machines 5*a*, 5*b*, 5*c*, ---, 5*x*, 5*y* and 5*z* comprising one group are a plurality of slave units 6*a*, 6*b*, 6*c*, ---, 6*x*, 6*y* and 6*z* respectively, each having a pair of first and second connectors 7 and 8. The master control unit intercommunicates with each of the slot machines 5*a* to 5*z* through the slave units 6*a* to 6*z* by exchanging messages which include data and commands relating to operations of the slot machines 5*a* to 5*z*.

The first connector 3 of the master control unit 2 is connected with the first connector 7 of the slave unit 6*a* through communication lines 10 comprising a transmitting cable 10*a* and a receiving cable 10*b*. The second connector 8 of the slave unit 6*a* is connected with the first connector 7 of the next slave unit 6*b* through the communication lines 10. By repeating such connections with the communication lines 10, all of the slave units 6*a* to 6*z* are connected in series. The second connector 8 of the last slave 6*z* is connected with the second connector 4 of the master control unit 2 through the communication lines 10. After all these connections have been made, the master control unit 2 and the slave to 6*z* form a looped communication circuit.

Each of the slot machines 5*a* to 5*z* incorporates respective slot machine control units 11*a*, 11*b*, 11*c*, ---, 11*x*, 11*y* and 11*z* each incorporating a microprocessor for controlling the individual operation of the respective slot machines 5*a* to 5*z*. Each of the slave units 6*a* to 6*z* exchanges messages including data and commands with the corresponding one of the slot machine control units 11*a* to 11*z*. There is provided an indicator 13 which is connected to the master control unit 2 so as to indicate the amount of money to be paid out for a JP. This indicator 13 is provided where it can be observed by all the players playing the slot machines 5*a* to 5*z*.

Figure 2:
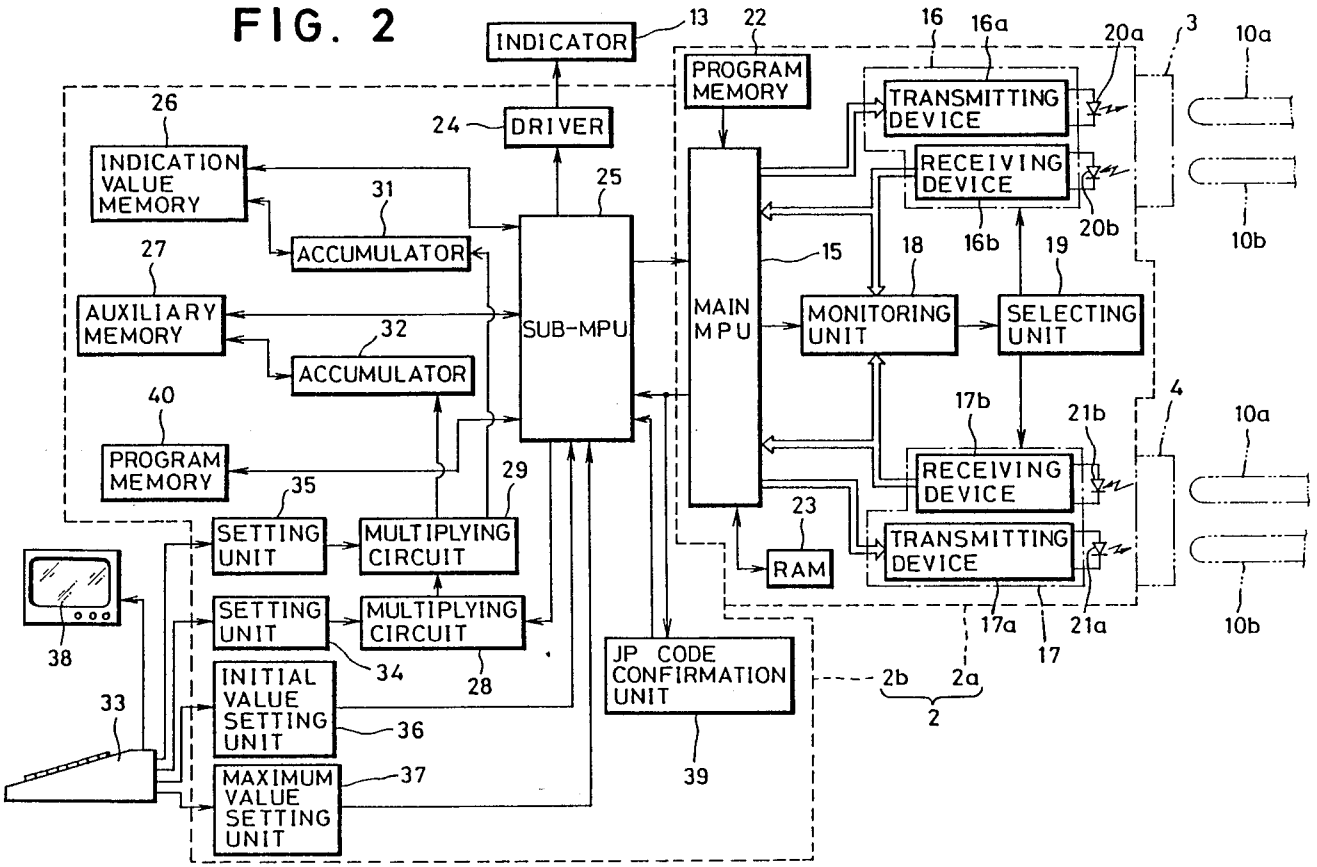
FIG. 2 is a block diagram showing the master control unit of FIG. 1.

As shown in FIG. 2, the master control unit 2 comprises a communication block 2*a* and a JP-process block 2*b*. The communication block 2*a* is provided with the first and second connectors 3 and 4, a main microprocessor unit (which is hereinafter referred to as a "main MPU") 15, first and second communication units 16 and 17, a monitoring unit 18, a selecting unit 19, a program memory (ROM) 22, and a RAM 23. The first and second communication units 16 and 17 have the same structure and function and they send messages to the slave units 6*a* to 6*z* and receive messages therefrom. The first communication unit 16 faces the first connector 3 and is provided with a transmitting device 16*a* and a receiving device 16*b*. The second communication unit 17 faces the second connector 4 and is provided with a transmitting device 17*a* and a receiving device 17*b*. The monitoring unit 18 monitors the state of the communication by checking the outputs of the receiving devices 16*b* and 17*b* of the first and second communication units 16 and 17 and outputs signals representing the state of the communication. According to the outputs of the monitoring unit 18, the selecting unit 19 selects one of the first and second communication units 16 and 17 and renders it operative. Therefore, the communication with the slave units 6*a* to 6*z* is carried out by using only one of the communication units 16 and 17.

In this embodiment, for optical communication, the transmitting devices 16*a* and 17*a* have light-emitting diodes 20*a* and 21*a*, and the receiving devices 16*b* and 17*b* have photo diodes 20*b* and 21*b*. It is to be noted that, as described before, only one of the communication units 16 and 17 is electrically actuated by the selecting unit 19. The transmitting and receiving cables 10*a* and 10*b* are made of optical fiber cables. The ends of these cables 10*a* and 10*b* are connected to or held in the connectors 3 and 4, which position the end faces of the cables 10*a* and 10*b* so as to face the light-emitting diodes 20*a* and 21*a* and the photo diode 20*b* and 21*b*.

According to programs for the communication, stored in the ROM 22, the communication units 16 and 17 and the monitoring unit 18 are operated in predetermined sequences and the RAM 23 stores the data in the received messages from the slave units 6*a* to 6*z* and a history of each slot machine 5*a* to 5*z*.

The JP-process block 2*b* has a sub-microprocessor unit (which is hereinafter referred to as a "sub-MPU") 25, two multiplying circuits 28 and 29, two accumulators 31 and 32, an indication value memory 26, an auxiliary memory 27, two setting units 34 and 35, an initial value setting unit 36, a maximum value setting unit 37, a driver 24, a JP code confirmation circuit 39, and a program memory 40. The sub-MPU 25 controls operations in the JP-process block 2*b* according to sequences stored in the program memory (ROM) 40 and processes data relating to the number of coins inserted in each of the slot machines 5*a* to 5*z*. First, a datum of a value "M" representing an amount of money corresponding to the number of the inserted coins is sent from the main MPU 15 to the multiplying circuit 28 so as to be used for obtaining a datum of a value "T" which is obtained by multiplying the value "M" by a constant "t" (total rate) less than "1". Then, the datum of the value "T" is sent to the multiplying circuit 29 and used for computing two values "J" and "K". The values "J" and "K" are obtained by the following calculations:

$$J = T \times (1 - \times)/100$$

$$K = T \times (1 - x)/100$$

where x is a storage rate. The storage rate "x" is entered with a keyboard 33 and is stored in the setting unit 35 and the total rate "t" is also entered with the keyboard 33 and is stored in the setting unit 34. A datum of the value "J" is further sent to the accumulator 31 to obtain a value "I" which is calculated by accumulation of the value "J". That is, the value "J" is added to a value "$I_o$" read out from the indication value memory 26 and then the content of the indication value memory 26 is updated by writing in the added value "I". The obtained value "I" is stored in the indication value memory 26 and indicated by the indicator 13. In addition to the value "J", a datum of the value "K" is further sent to the accumulator 32 and a value "S" is calculated by accumulating the value "K".

Suppose that 0.01 (1%) is set as the total rate "t", 0.4 (40%) is set as the storage rate "x", and three coins of $1 are inserted into one of the slot machines 5*a* to 5*z* for playing one game. According to the multiplication and accumulation described above, the value "J" ($J = 0.01 \times 0.6 \times 3$) is 1.8¢, and the value "K" ($K = 0.01 \times 0.4 \times 3$) is 1.2¢. These values "J" and "K" are accumulated in the accumulators 31 and 32 and stored in the indication value memory 26 and the auxiliary memory 27 respectively. If the amount of money to be indicated and paid out is a fraction, the fraction is rounded up or down.

The initial value setting unit 36 is provided for setting a predetermined initial value "$S_o$" with the keyboard 33. After coins are paid out for a JP according to the value I stored in the indication value memory 26, the data in the indication value memory 26 are cleared to zero and then the value S stored in the auxiliary memory 27 is transferred to the indication value memory 26. The auxiliary memory 27, after resetting, stores the initial value "$S_o$". The initial value "$S_o$" is previously determined based on the JP occurrence probability and pay-out ratio. Accumulation of the values "K," to form a new value "S, " starts from the value "$S_o$" and then accumulation of the values "J," to form a new value "I" is performed after transfer of the value "S" to the indication memory 26. Hence, the initial value "$S_o$" may be not very large.

The maximum value setting unit 37 is provided for setting a maximum value "$IS_{max}$" and can be variably set with the keyboard 33. A monitor 38 displays the values "t", "x", "$S_o$8 and "$IS_{max}$" for easy understanding of the JP-process. The JP code confirmation unit 39 confirms whether a message sent from the main MPU 15 is a JP occurrence message or not. The program memory 40 stores the above-described sequences performed by the sub-MPU 25.

Figure 3:
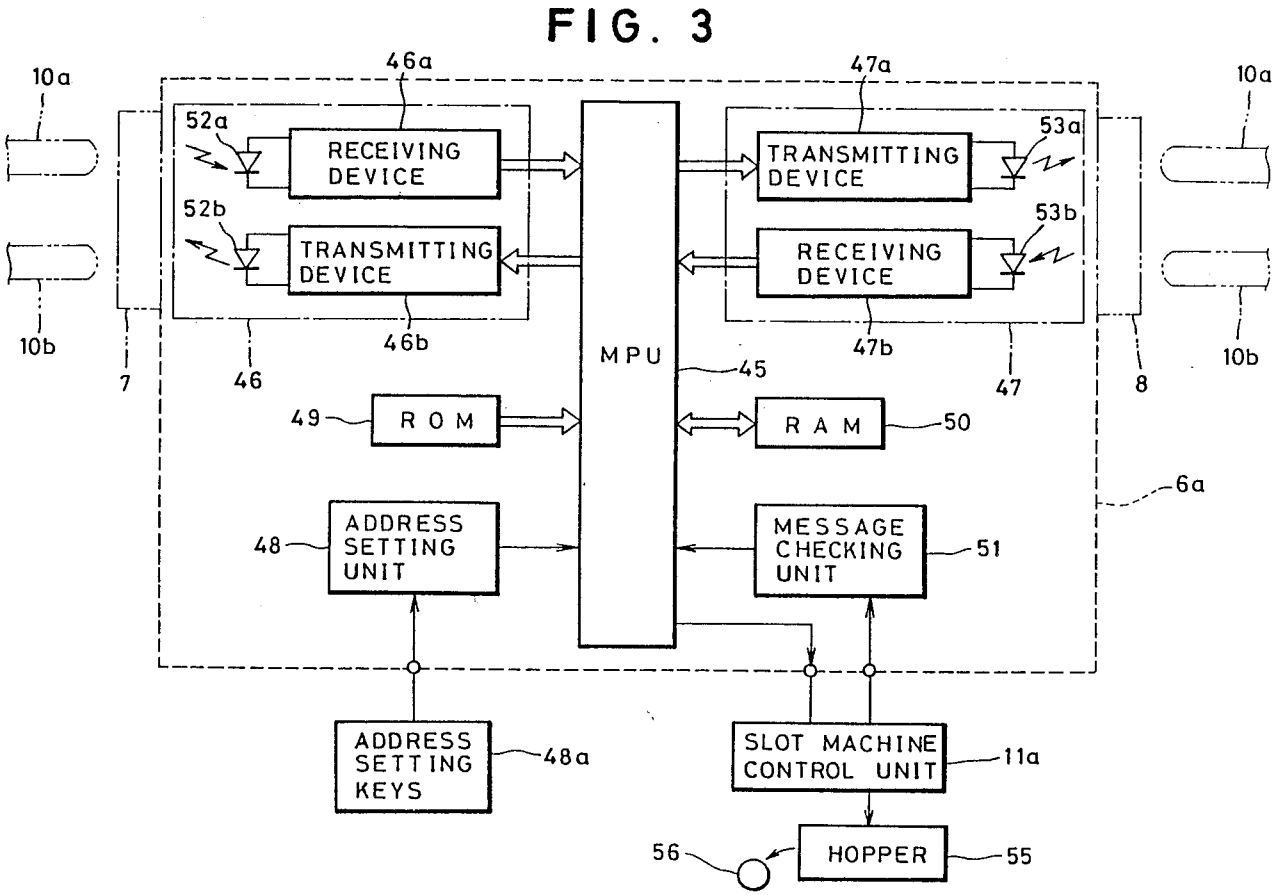
FIG. 3 is a block diagram showing a slave unit in one slot machine of FIG. 1.

FIG. 3 shows a schematic diagram of the slave unit **6*a* which is the same as the other slave units 6*b* to 6*z*. Therefore, the explanation for the slave units 6*a* to 6*z* will be given only for the slave unit 6*a*. The slave unit 6*a* comprises a microprocessor unit (which is hereinafter referred to as a "slave MPU") 45, a first communication unit 46 having a first receiving device 46*a* and a first transmitting device 46*b*, a second communication unit 47 having a second receiving device 47*a* and a second transmitting device 47*b*, an address setting unit 48 for allocating an address to the slave unit 6*a*, a ROM 49, a RAM 50, and a message checking unit 51. The ROM 49 stores a sequential-processing program for the slave unit 6*a*, according to which the slave MPU 45 will operate. In the message checking unit 51, messages from the slot machine control unit 11*a* are checked as to whether or not the message meets the conditions of a predetermined format. This slot machine control unit 11*a* controls the sequence and the processes of the games of the slot machine 5*a* and outputs data such as the number of inserted coins, to the slave unit 6*a* for JP-processing by the progressive method described later. Furthermore, when a hit occurs in the slot machine 5*a*, the slot machine control unit 11*a* pays out coins according to the kind of hit, into a well-known hopper 55**.

The first and second receiving devices **46*a* and 47*b* have photo diodes 52*a* and 53*b* respectively for receiving message signals, and the first and second transmitting devices 46*b* and 47*a* have light-emitting diodes 52*b* and 53*a* for transmitting message signals. The photo diodes 52*a* and 53*b* and the light-emitting diodes 52*b* and 53*a* are the same as those used for the receiving and transmitting devices 16*a*, 16*b*, 17*a* and 17*b* in the master control unit 2** which performs optical communication.

Each of the slot machine control units **11*a* to 11*z*** controls the associated slot machine with respect to the following, in the order of operation sequence of the slot machine for a game:

detection of insertion of coins;

counting the inserted coins;

detection of pulling of the slot machine start lever;

operation of the starting and stopping of the slot machine reels;

decision as to whether the game is to be a hit or not and if a hit the kind of hit; and operation of pay-out of coins according to the kind of the hit when the game is a hit.

When coins are inserted for a game, the slot machine control unit generates and sends a coin data message to the slave unit. The coin data message comprises a series of several bytes including a start code for the first byte of 8 bits, a coin data code for intermediate bytes, and an end code for the last byte. The coin data message depends on the number of inserted coins.

The operation of this embodiment will now be described in detail. Referring to FIG. 3, the coin data message is sent to the message checking unit 51 of the slave unit **6*a* from the slot machine control unit 11*a* so as to be checked as to format; and only when the coin data message is correct as to format does the slave MPU 45 store the data in the RAM 50. When the coin data message is judged to be incorrect as to format, the slave MPU 45 refuses to receive the coin data, and then the coin data are not stored in the RAM 50**.

Figure 4:
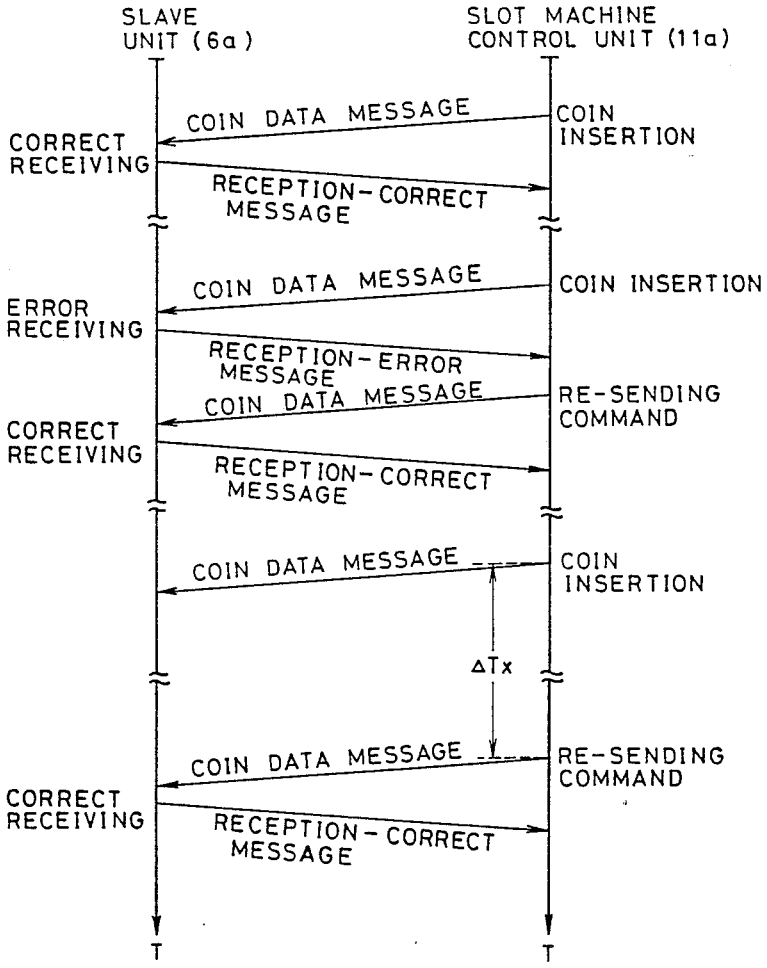
FIG. 4 is a time chart explaining the sending/receiving of messages between one of the slave units and the corresponding one of the machine control units of FIG. 1.

FIG. 4 shows an example of message communication between the slave unit **6*a* and the corresponding slot machine control unit 11*a*. Only the communication with respect to the slave unit 6*a* is explained because the communications with respect to the other slave units 6*b* to 6*z* are the same as that of the slave unit 6*a*. Upon correctly receiving a coin data message from the slot machine control unit 11*a*, the slave unit 6*a* sends a reception-correct message to the slot machine control unit 11*a*. But upon incorrectly receiving a coin data message from the slot machine control unit 11, the slave unit 6*a* sends a reception-error message to the slot machine control unit 11*a*. In this case, the slot machine control unit 11*a* again sends the same coin data message to the slave unit 6*a*. Furthermore, when no reception-correct message is sent to the slot machine control unit 11*a* from the slave unit 6*a* for a predetermined time $\Delta t_x$, the slot machine control unit 11*a* also sends the coin data message again. Such communication also takes place between each of other slave units 6*b* to 6*z* and the corresponding one of the slot machine control units 11*b* to 11*z*, and the data as to the number of the inserted coins are stored in each of RAMs 50**.

Figure 5:
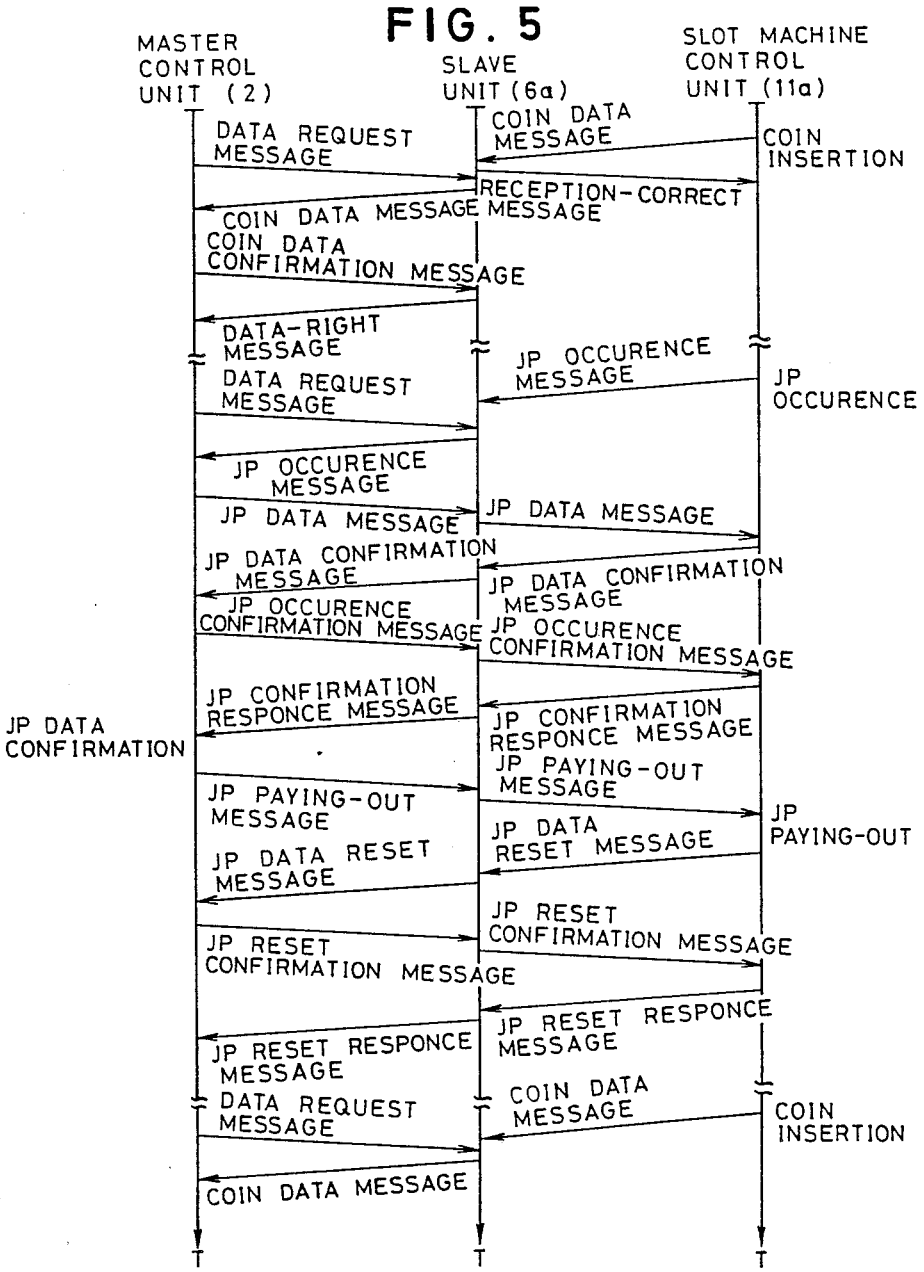
FIG. 5 is a time chart explaining the sending/receiving of messages between the master control unit and one of the slot machine control units of the control system of FIG. 1 through a corresponding slave unit.

The communication between the slave unit **6*a* and the communication block 2*a* of the master control 2 is illustrated by the time chart of FIG. 5. A message including data and commands is generally constructed according to the basic format shown in FIG. 6**. The message consists of serial codes, namely a start code (STX), an address code (ADR), a command code (CMD), a text (TXT), a check sum (CHS), and an end code (EXT), each of which is represented by a combination of binary digits "1" to "0". Each code consists of 8 bits except for the text (TXT).

Figures 6, 7:
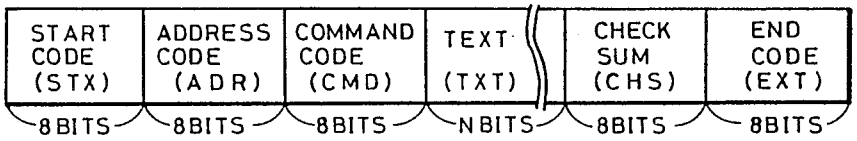
FIG. 6 is an illustration explaining the basic format of a message used for communication performed by the control system of FIG. 1.
FIG. 7 shows a command code table, the command codes being included in messages for a communication.

A command code table is shown in FIG. 7 in which the upper four digits are arranged in a row and the lower digits are arranged in a column. According to this table, the start code is represented by "02" in hexadecimal notation, e.g., "&H02", the end code is "&H03", the data request command is "&H20", and the coin data code is "&H30". The check sum (CHS) is obtained, first by performing an exclusive OR operation in which each digit from the start code (STX) to the text (TXT) for each digit of the lower seven bits is added (eliminating their carries), and secondly by setting the most significant bit (MSB) "1". The check sum (CHS) obtained in this way is used, as is well known, to make sure that the message includes no error data.

Figure 8:
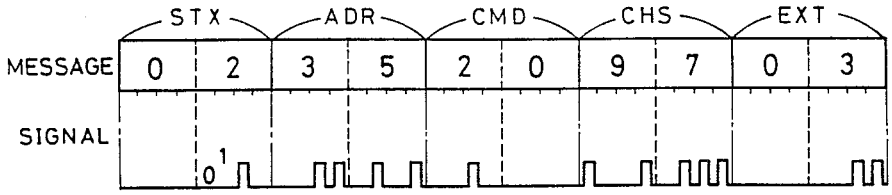
FIG. 8 is an illustration explaining schematically a data request message used for a communication.

The communication block 2a periodically sends data request messages of a constant duration to the slave unit 6a according to a sequence program stored in the program memory 22. The structure of the data request message is schematically shown in FIG. 8. In FIG. 8, also their actual serial binary signals corresponding to the data of the data request message are shown. For example, at the time corresponding to the binary signal "1", the light-emitting diode 20a will turn on. Therefore, the data request message as well as other messages are transmitted to the photo diode 52a of the slave unit 6a in the form of a series of on-and-off light signals through the transmitting cable 10a.

As shown in FIG. 8, when the address code in the data request message is "&H35", the address code "&H35" specifies a slave unit having an address "5". When the slave unit 6a has an address "5", the slave unit 6a receives the data request message and in reply sends the coin data message including the number of the inserted coins to the communication block 2a through the first transmitting device 46b. The number of the inserted coins is read out from the RAM 50.

After the master control unit 2 has received the coin data message, the master control unit 2 sends a coin data confirmation message to the slave unit 6a to confirm whether the number is accurate or not. Then, the slave unit 6a collates the number of the inserted coins in the coin data confirmation message with the number of the inserted coins stored in the RAM 50. If the numbers coincide, the slave unit 6a sends a reception-correct message to the master control unit 2 and simultaneously clears the data in the RAM 50. If the numbers do not coincide, a reception-error message is sent from the slave unit 6a to the master control unit 2, and again the same data request message is sent to the slave unit 6a.

The slave unit 6a transfers the data request message, from the master control unit 2 to the next slave unit 6b, through the transmitting device 47a. Similarly, the next slave unit 6b also transfers the data request message to the slave unit 6c. In this way, the data request message is transferred by all the slave units and finally reaches the communication unit 17 of the communication block 2a, having fully traversed the looped communication circuit. By operating the receiving device 17b of the second communication unit 17 while the first communication unit 16 is effective, the transmitting state of at least the communication cable 10a may be monitored by checking the outputs of the receiving device 17b by the monitoring unit 18.

Figure 9:
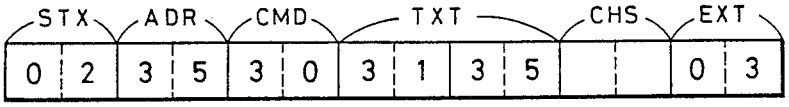
FIG. 9 is an illustration explaining a coin data message used for a communication.

A coin data message is schematically illustrated in FIG. 9, in which, following a command code having a code "&H30" indicating that this message is a coin data message, a text having codes "&H31" and "&H35" is shown. These data "&H31" and "&H35" mean that the number of coins inserted into the slot machine 5a is fifteen. The coin data message, as described above, is comprised by a series of on-and-off light signals from the light-emitting diode 52b in the transmitting device 46b, to be sent to the photo diode 20b of the communication block 2a through the communication cable 10b.

When the datum of the number of the inserted coins is, in this way, sent from the slave unit 6a having the address "5", the datum is stored in the RAM 23 of the communication block 2a. After converting the datum read out from the RAM 23 to an amount of money corresponding to the number of inserted coins, the main-MPU 15 sends this value to the JP-process block 2b. In the JP-process block 2b, this value is computed with the multiplying circuits 28 and 29 successively, and accumulated by the accumulators 31 and 32 at two different rates, as described before. The two differently-accumulated values "I" and "S" are stored in the indication value memory 26 and the auxiliary memory 27 separately.

Suppose that the total rate "t" is set as 0.01 (1%), the storage rate "x" is set as 0.4 (40%), and the amount of money "M" corresponding to the number of the inserted coins is 3 ($3). According to the calculations, the value "J" is 1.8¢ and the value "K" is 1.24¢. The value "J" is added to the value "I" stored in the indication value memory 26. The value "K" is added to the value "S" stored in the auxiliary memory 27.

For collection, calculation and storing of the coin data of the other slot machines 5b to 5z, the communication block 2a sends the data request messages successively to the slave units 6b to 6z, varying the address code. Therefore, the communication block 2a can obtain the coin data with respect to the number of coins inserted into each of the slot machines 5a to 5z. Based on all the messages, the values "I" and "S" in the indication and auxiliary memories 26 and 27 are updated.

Figure 10:
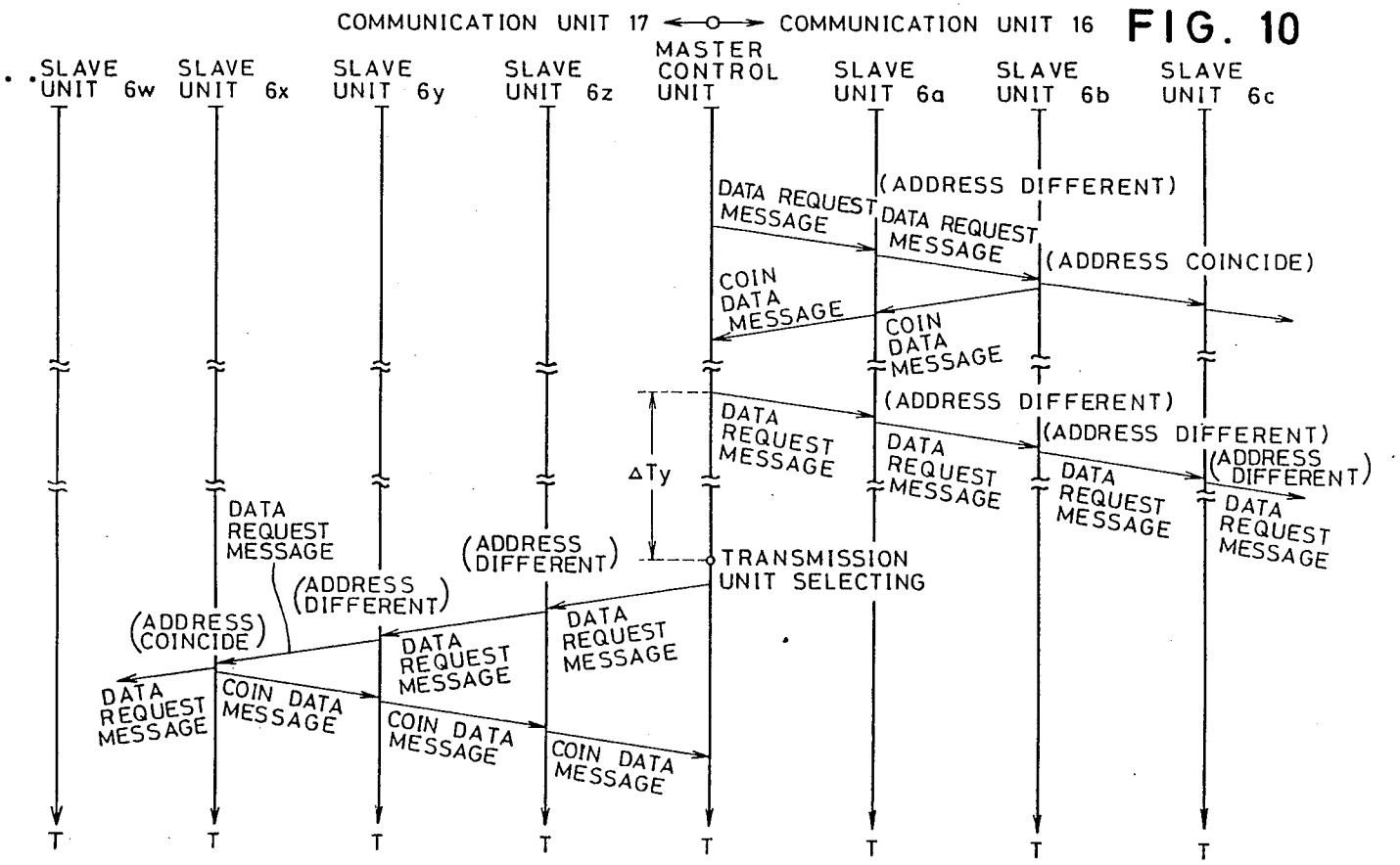
FIG. 10 is a time chart explaining the operation of switching communication units provided in the master control unit of FIG. 2.

FIG. 10 shows an automatic detection in case the communication is partially interrupted due to disconnection of the communication line 10, for example, between the slave units 6w and 6x. The data request messages for the slave units 6x, 6y and 6z cannot reach each of the slave units 6x to 6z by use of the first communication unit 16. When the monitoring unit 18 detects that no coin data message from the slave unit 6x has been received for a pre-fixed time $\Delta t_y$ because the slave unit 6a cannot receive a data request message, the selecting unit 19 renders the second communication unit 17 operative in lieu of the first communication unit 16. Then, the same data request messages are transmitted through the transmitting device 17b in a reverse direction in the looped communication circuit, reaching the slave unit 6x. The slave unit 6x sends its coin data message in response, from the second communication unit 47 to the second communication unit 17 of the communication unit 2a. And thereafter other slave units 6y and 6z which cannot receive the data request messages by use of the first communication unit 16 also can successively receive the data request message and send their coin data messages by the second communication unit 17. For the next cycle of communication with the slave units 6a to 6w, the first communication unit 16 is again rendered operative. Then, for message exchange with the slave units 6x to 6z, the second communication unit 17 is made effective alternatively by monitoring unit 18 and selecting unit 19. In this way, even if a cable disconnection occurs in this system, the communication unit 2a can obtain messages from all of the slave units 6a to 6z by alternatively using either of the first and second communication units 16 and 17 to continue the communication without interruption.

The time period $\Delta t_y$ is set to be a little longer than the period from the time when the data request message is fed from the master control unit 2 until the time when the response message from a corresponding slave unit reaches the master control unit 2. An indicator may be provided to indicate which communication cable is disconnected. After reconnection of this communication cable, the intercommunication by means of only the first communication unit 16 can resume.

Until the next JP occurs in any of the slot machines 5a to 5z, part (0.6%=0.01×0.6) of the amount of money corresponding to the number of the inserted coins is accumulated in the indication memory 26 and another part (0.4%) is accumulated in the auxiliary memory 27 for every coin insertion. The value "I" stored in the indication value memory 26 is indicated by the indicator 13 through the driver 24, letting players of the slot machines know the amount of money to be paid out for a JP which occurs in the group of slot machines 5a to 5z. It should be noted that only one of predetermined denominations of coin, for example $1 coins, can be inserted in each of the slot machines belonging to one group. Therefore coins of other denominations are rejected.

Because usually the probability of the occurrence of a JP is determined to be extremely small, the values "I" and "S" often increase to very large ones. Viewing the indication of a large amount of money, the players can enjoy the prospect of a big win. Because of setting the maximum value "$IS_{max}$" for the values "I" and "S", the amount of money to be paid out for a JP cannot exceed the maximum value "$IS_{max}$", for example, $5,000. After the indicated value reaches the "$IS_{max}$", the indicator 13 continues to indicate the "$IS_{max}$" and the accumulation of the values "I" and "S" stops until the next JP occurs.

Figure 11:
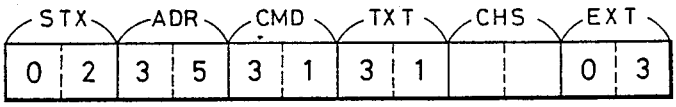
FIG. 11 is an illustration explaining a JP occurrence message used for a communication.

Next, a sequence of message exchange between the master control unit 2 and one of the slot machine control units 6a to 6z will be explained for when a JP occurs in the corresponding slot machine. If a JP takes place, for example, in the slot machine 5a, a message having data representing the occurrence of a JP is sent from the slot machine control unit 11a to the slave unit 6a as shown in FIG. 5, in order to store the data in the RAM 50. When a data request message for the slave unit 6a is sent from the master control unit 2, the slave unit 6a sends a JP occurrence message, whose schematic structure is illustrated in FIG. 11. In the command code (CMD) and text (TXT) of this JP occurrence message, the JP code "&H31" representing a JP occurrence is contained commonly.

The communication block 2a of the master control unit 2 receives the JP occurrence message and collates the JP code of the message with a JP code stored in the JP code confirmation unit 19. When the two codes coincide, the communication block 2a orders the sub-MPU 25 in the JP-process block 2b to start JP processing.

Figure 12:
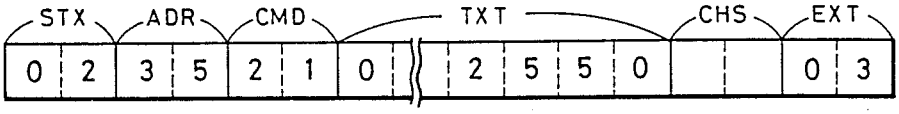
FIG. 12 is an illustration explaining a JP data message used for a communication.

For the JP processing, first, the value I stored in the indication value memory 26 is transferred to the main MPU 15 through the sub-MPU 25. The main MPU 15 sends a JP data message to the corresponding slave unit 6a. An example of the JP data message is shown in FIG. 12, in which the command code (CMD) "&H21" represents that this message is a JP data message and the text (TXT) "2550" represents that the amount of money is $2,550.00. The number of digits of the text (TXT) is set according to the number of digits of the amount of money to be paid out for a JP.

When this JP data message is supplied to the slot machine control unit 11a through the corresponding slave unit 6a, the slot machine control unit 11a stores the data as to the amount of money to be paid out and sends to the main MPU 15 a JP data confirmation message for confirming that the data are correctly received. This message includes a command code (CMD) "&H33" representing a JP response and a text (TXT) representing the value "I" which has been received by the slot machine control unit 11a.

The communication unit 2a orders the sub-MPU 25 to judge whether the text code in this JP data confirmation message is valid or not by comparison with the data of the value "I". When the code is valid, a JP occurrence confirmation message is fed to the slot machine control unit 11a through the slave unit 6a. Then, the slot machine control unit 11a reconfirms that the JP has surely occurred in this slot machine 5a and sends a JP confirmation response message to the master control unit 2 so that the master control unit 2 makes a final confirmation of the occurrence of a JP in the slot machine 5a.

After the final confirmation, the master control unit 2 sends a JP pay-out message to the slave unit 6a, which instructs the slot machine control unit 11a to pay out coins. Upon reception of the JP pay-out message, a hopper 55 operates to pay out coins under control of the slot machine control unit 11a, according to the value "I" as specified in the JP data message. The number of coins to be paid out is calculated according to the value "I" in the slot machine control unit 11a.

After the actual pay-out of the coins by the hopper 55, the slot machine control unit 11a sends a JP data reset message to the master control unit 2 through the slave control unit 6a. This JP data reset message includes a command code "&H34" representing resetting of the value "I". After receiving the JP data reset message, the communication unit 2a sends by way of confirmation, a JP reset confirmation message to the slot machine control unit 11a through the slave unit 6a, and then the slot machine control unit 11a sends a JP reset response message to the master control unit 2. When the master control unit 2 has received the JP reset response message, the main MPU 15 sends a JP pay-out end message to the sub-MPU 25.

When the sub-MPU 25 receives the JP pay-out end message, the sub-MPU 25 clears the data of the indication value memory 26 and then transfers the value "S" in the auxiliary memory 27 to the indication value memory 26. Thereafter the sub-MPU 25 clears the data of the auxiliary memory 27 and then transfers the initial value "$S_o$", for example "1000", in the initial value setting unit 26 to the auxiliary memory 27, completing the whole of the JP-process.

There are many kinds of hit other than a JP, and as is well known to those who are skilled in the art, for these hits, each slot machine control unit identifies the kind of each hit and orders the slot machine to pay out coins according to the identified kind.

According to the JP-process described above, even if a JP occurs immediately after a preceding JP, the amount of money to be paid out is not unduly reduced for the largest hits because the value "I" for the JP starts from the value "$S_o$" which is transferred to the indication value memory 26. Therefore, the player can start or continue slot machine games without loss of interest.

In the above embodiment, at the beginning of the operation of the system, the indication value memory 26 is set "0", the auxiliary memory 27 is set "1000" transferred from the initial value setting unit 36, and the indicator indicates "$0". A false JP pay-out end message may be fed to the sub-MPU 25 so as to set the initial value "1000" in the indication value memory 26 as the value "I". The constants "t", "x", and "$S_o$" can be manually changed with the keyboard 33 at any time.

When the storage rate "x" is set greater than 0.5, the rate of increase of the value "S" is greater than that of the value "I" and accordingly the amount of money to be paid out for a JP is greater than that for the preceding JP, thereby arousing the speculative interest of the players.

Although the functions of the indication value memory 26 and the auxiliary memory 27 differ from each other in the illustrated embodiment, these memories 26 and 27 may be used equally for the indication and the pay-out. That is, after the occurrence of a JP, the initial value "$S_o$" is set in the indication value memory 26. The value "S" in the auxiliary memory 27 is used as the pay-out value for the next JP and is indicated by the indicator 13. When the memories 26 and 27 are thus used alternately, the storage rate "x" is preferably set as 0.5.

There is another method for determining the amount of money to be paid out for a JP, other than the method as in the above embodiment, that is, the greatest value among the values "I", "S", and "$S_o$" may be used upon comparing them.

The indicator 13 in the illustrated embodiment is located at a place where all players of the slot machine belonging to one group can view the indicator 13. Instead of the indicator 13, each slot machine may be provided with an indicator for indicating the amount of money to be paid out for a JP, or indicating the number of coins to be actually paid out because the denomination is predetermined for each group of the slot machines.

Although a hopper is used in each slot machine as the pay-out means in the illustrated embodiment, a well-known credit device may be provided in combination with the hopper. In slot machines with such a credit device, coins are not actually paid out each hit but the number of coins to be paid out is accumulated by a credit counter and the accumulated number of coins is displayed by a credit display of the credit device. Before a game starts, the number in the credit counter decreases by a predetermined value necessary for one game. A player can play games without the insertion of coins until the number in the counter becomes "0". When the player discontinues the game and the number is not yet "0", an adjustment button of the credit device is operated and then coins whose number corresponds to the number in the credit counter are paid out into the hopper.

Obviously many other modifications and variations of the present invention are possible in the light of the above teachings. It is therefore to be understood that within the scope of the claims the invention may be practiced otherwise than as specifically described.

What is claimed is:

1. An apparatus for controlling a group comprised by a plurality of game machines each of which has pay-out means for paying out coins according to the kind of win, said apparatus being provided with means for indicating a pay-out value for a particular win, said apparatus comprising:

first calculating means for calculating a first accumulation value by accumulating, at a first rate, the value of coins inserted into each of said game machines;

second calculating means for calculating a second accumulation value by accumulating, at a second rate, the value of said inserted coins; and controlling means for ordering said indicating means to indicate one of said first and second accumulation values as said pay-out value, for ordering said pay-out means of a said game machine in which said particular win occurs to pay out coins of a number which corresponds to said pay-out value, and for ordering said indicating means to indicate the other of said first and second accumulated values as said pay-out value after said particular win occurs.

2. An apparatus as claimed in claim 1, further comprising first setting means for setting an initial value of said accumulation values and for inputting said initial value into the one of said first and second calculating means of which the accumulation value is used as said pay-out value.

3. An apparatus as claimed in claim 2, further comprising second setting means for setting a maximum value for said pay-out value.

4. An apparatus as claimed in claim 3, further comprising third setting means for setting said first and second rates.

5. An apparatus as claimed in claim 4, wherein said third setting means comprises total rate setting means for setting a total rate so as to obtain a total insertion value which is multiplied by said insertion value and distribution rate setting means for setting a distribution rate by which said total insertion value is divided into said first and second rates.

6. An apparatus as claimed in claim 1, wherein said first and second accumulation values are calculated as money.

7. An apparatus as claimed in claim 1, wherein said first and second accumulation values are calculated as numbers of coins.

8. An apparatus as claimed in claim 1, wherein said first calculating means comprises a first accumulator for obtaining said first accumulation value and a first memory for storing said first accumulation value, and said second calculating means comprises a second accumulator for obtaining said second accumulation value and a second memory for storing said second accumulation value.

9. An apparatus as claimed in claim 8, wherein said first accumulation value stored in said first memory is used as said pay-out value, said second accumulation value stored in said second memory is transferred to said first memory after paying out coins according to said particular win, and an initial value greater than zero is set in said second memory.

10. An apparatus as claimed in claim 1, wherein said controlling apparatus and said game machines form a looped communication circuit in which said game machines are connected in series and both end game machines of said series-connected game machines are connected to said controlling apparatus, whereby said controlling apparatus receives a message containing data as to the value of coins inserted into each of said game machines for each game, and whereby when said particular win is made in a said game machine, said controlling apparatus orders said game machine to perform pay-out for said particular win.

11. An apparatus as claimed in claim 1, wherein said second rate is different from said first rate.

12. An apparatus as claimed in claim 1, wherein said second rate is a function of said first rate.

13. An apparatus for controlling a group comprised by a plurality of game machines each of which has prize awarding means for awarding prizes according to the kind of win, said apparatus being provided with means for indicating a prize value for a particular win, said apparatus comprising:

first calculating means for calculating a first accumulation value by accumulating, at a first rate, the amounts input into each of said game machines;

second calculating means for calculating a second accumulation value by accumulating, at a second rate, said input amounts; and controlling means for ordering said indicating means to indicate one of said first and second accumulation values as said prize value, for ordering said prize awarding means of a said game machine in which said particular win occurs to award a prize which corresponds to said prize value, and for ordering said indicating means to indicate the other of said first and second accumulated values as said prize value after said particular win occurs.

* * * * *